US012053673B2

(12) United States Patent
Lee

(10) Patent No.: US 12,053,673 B2
(45) Date of Patent: Aug. 6, 2024

(54) BICYCLE SIMULATOR

(71) Applicant: REAL DESIGN TECH CO., LTD., Gyeonggi-do (KR)

(72) Inventor: Joong Sik Lee, Gyeonggi-do (KR)

(73) Assignee: REAL DESIGN TECH CO., LTD., Gyeonggi-do (KR)

( * ) Notice: Subject to any disclaimer, the term of this patent is extended or adjusted under 35 U.S.C. 154(b) by 137 days.

(21) Appl. No.: 17/120,806

(22) Filed: Dec. 14, 2020

(65) Prior Publication Data

US 2021/0093922 A1 Apr. 1, 2021

Related U.S. Application Data

(63) Continuation of application No. PCT/KR2019/004518, filed on Apr. 15, 2019.

(30) Foreign Application Priority Data

Jun. 14, 2018 (KR) ..... 10-2018-0068395
Jul. 16, 2018 (KR) ..... 10-2018-0082338
(Continued)

(51) Int. Cl.
*A63B 24/00* (2006.01)
*A63B 22/06* (2006.01)
(Continued)

(52) U.S. Cl.
CPC ..... *A63B 24/0087* (2013.01); *A63B 22/0605* (2013.01); *A63B 24/0062* (2013.01);
(Continued)

(58) Field of Classification Search
None
See application file for complete search history.

(56) References Cited

U.S. PATENT DOCUMENTS 4,082,265 A * 4/1978 Berkes ..... A63B 26/003 482/61
4,580,983 A 4/1986 Cassini et al.
(Continued)

FOREIGN PATENT DOCUMENTS

CN 2411031 Y 12/2000
CN 2608970 Y * 3/2004
(Continued)

OTHER PUBLICATIONS

Supplementary Partial European Search Report issued in corresponding EP Application No. 19818557.1, issued Jan. 19, 2022, 13 pages.
(Continued)

*Primary Examiner* — Shila Jalalzadeh Abyaneh
(74) *Attorney, Agent, or Firm* — Guntin & Gust, PLC; Miyoung Shin

(57) ABSTRACT

A bicycle simulator is arranged by arranging a front wheel and a rear wheel of a bicycle on the same plane. The bicycle simulator includes a front roller that supports a front wheel of a bicycle that is mounted and rotates together with a rotation of the front wheel, The bicycle simulator further includes a rear roller that supports a rear wheel of the bicycle and rotates together with a rotation of the rear wheel. A first support point at which the front roller supports the front wheel and a second support point at which the rear roller supports the rear wheel are arranged on the same plane. Not only a substantially flat ride path but also various ride modes in which an inclination angle may be adjusted according to a ride mode may be implemented, and a dynamic experience similar to the actual ride situation may be enjoyed.

8 Claims, 15 Drawing Sheets

(30) Foreign Application Priority Data

Oct. 5, 2018 (KR) ..... 10-2018-0119322
Jan. 10, 2019 (KR) ..... 10-2019-0003287

(51) Int. Cl.
*A63B 69/16* (2006.01)
*A63B 71/06* (2006.01)

(52) U.S. Cl.
CPC ..... *A63B 69/16* (2013.01); *A63B 71/0622* (2013.01); *A63B 2024/009* (2013.01); *A63B 2024/0093* (2013.01); *A63B 2071/0644* (2013.01); *A63B 2220/30* (2013.01)

(56) References Cited

U.S. PATENT DOCUMENTS 4,932,651 A * 6/1990 Defaux ..... A63B 69/16 482/61
5,035,418 A * 7/1991 Harabayashi ..... A63B 22/16 482/57
5,076,792 A * 12/1991 Niermann ..... G01M 17/0076 482/61
7,784,335 B2 * 8/2010 Fukamachi ..... G01L 5/282 73/121
2011/0136630 A1 * 6/2011 Zwinkels ..... A63B 69/16 482/61
2012/0071301 A1 * 3/2012 Kaylor ..... A63B 21/00058 482/57
2015/0133272 A1 * 5/2015 Papadopolous ..... A63B 69/16 482/61
2016/0023045 A1 * 1/2016 Dalebout ..... A63B 24/0087 482/8
2016/0236036 A1 * 8/2016 Kalogiros ..... A63B 22/0023
2017/0189778 A1 * 7/2017 Kimura ..... A63B 69/16
2018/0036619 A1 * 2/2018 Kim ..... A63B 22/02
2018/0218637 A1 * 8/2018 Lee ..... G16H 20/60
2019/0328322 A1 * 10/2019 Inada ..... A61B 5/4866

FOREIGN PATENT DOCUMENTS

CN 204882093 U * 12/2015
CN 205886063 U * 1/2017
CN 106861181 * 6/2017
CN 106861181 A * 6/2017 ..... A63B 22/0605
CN 106861181 A * 6/2017
CN 206823111 U 1/2018
EP 2677293 A1 * 12/2013 ..... G01M 17/0074
JP H02136674 * 11/1990
JP H02136674 U * 11/1990
JP H02136674 U 11/1990
KR 20000060659 A * 10/2000
KR 10-2015-0117460 10/2015
KR 20150117460 * 10/2015
KR 20150117460 A * 10/2015
KR 20160076547 A * 7/2016
KR 10-2016-0111704 9/2016
KR 10-1677713 11/2016
KR 101677713 * 11/2016
KR 101677713 B1 * 11/2016
KR 101780743 * 9/2017
KR 101780743 B1 * 9/2017
KR 10-1827306 2/2018

OTHER PUBLICATIONS

International Search Report for International Application PCT/KR2019/004518, mailed Jul. 26, 2019.
Office Action issued in corresponding KR Application 10-2019-0003287, mailed Dec. 10, 2019.
Notice of Allowance issued in corresponding KR Application 10-2019-0003287, mailed Jun. 16, 2020.

* cited by examiner

BICYCLE SIMULATOR

CROSS-REFERENCE TO RELATED APPLICATIONS

This application is a continuation of International Application No. PCT/KR2019/004518, filed on Apr. 15, 2019, which claims priority to and the benefit of Korean Patent Application No. 10-2019-0003287, filed on Jan. 10, 2019, Korean Patent Application No. 10-2018-0119322, filed on Oct. 5, 2018, Korean Patent Application No. 10-2018-0082338, filed on Jul. 16, 2018, and Korean Patent Application No. 10-2018-0068395, filed on Jun. 14, 2018. The disclosures of the above applications are incorporated herein by reference.

TECHNICAL FIELD

One or more embodiments relate to a bicycle simulator for virtual rides, and more particularly, to a bicycle simulator in which various ride routes may be virtually experienced in an indoor space and exercise effects may be thus obtained.

BACKGROUND

In general, bicycle exercise equipment, which is named bicycle trainer or bicycle roller, is the most widely used indoor exercise fitness equipment along with a treadmill. Here, a rider on a bicycle mounted on a rotating roller or a cradle strengthens lower body strength by pedaling the wheels to which rotational resistance (magnetic force, etc.) is applied.

Such related-art bicycle exercise equipment has an advantage in that a considerably high exercise effect is provided to a rider with only a relatively short time of exercise through the adjustment of rotational resistance applied to the wheels regardless of the weather.

However, the related-art bicycle exercise equipment simply continues the pedaling exercise to which rotational resistance is applied while facing the wall in a closed indoor space. Thus, there is a drawback in that it is difficult to continue the continuous pedaling exercise due to boredom from the inability to provide the rider with the pleasure of actually riding a bicycle.

In order to improve the above problem, prior art 1 (Korean Patent No. 10-1677713) and prior art 2 (Korean Patent No. 10-1827306) disclose technologies relating to cycle exercise equipment.

In prior art 1, by replacing three or more roller portions each rotating about a fixed axis (center axis) and having different outer wall shapes, the rider may be provided with riding experiences under various road conditions similar to when riding a real bicycle, and through the interest induced thereby, the rider may continue the pedaling movement in a continuous manner.

In prior art 2, an uneven portion capable of implementing a virtual road surface protrudes along the roller portion, thus providing a safer riding experience and natural change of the road surface to the rider. However, in prior art 1 and prior art 2, one front roller is arranged to support the front wheel of the bicycle, whereas two rear rollers are arranged to support the rear wheel of the bicycle. Thus, a difference in height may occur between the front and rear wheels of the bicycle, and accordingly, even when implementing a flat virtual road surface, the rider may experience the same ride as actually riding an inclined portion having an ascent. In addition, the cycle exercise equipment presented in prior art 1 and prior art 2 only implements a flat virtual road surface, and is not capable of implementing an actual riding environment including a slope, such as mountain biking, and various ride modes according to the type of rider.

SUMMARY

One or more embodiments provide a bicycle simulator in which, when implementing a flat virtual road surface environment, the front and rear wheels of a bicycle are supported on the same plane to coincide with the actual riding environment and thus, no unnecessary force is generated for the rider.

In addition, one or more embodiments provide a bicycle simulator that implements a riding state that has a slope such as mountain bike riding, and thus, a dynamic experience very similar to the actual riding situation may be achieved.

According to an embodiment of the disclosure, a bicycle simulator includes a front roller that supports a front wheel of a bicycle that is mounted, and rotates together with a rotation of the front wheel, and a rear roller that supports a rear wheel of the bicycle, and rotates together with a rotation of the rear wheel, wherein a first support point at which the front roller supports the front wheel and a second support point at which the rear roller supports the rear wheel are arranged on the same plane.

The bicycle simulator may further include a base portion to which both ends of the front roller and both ends of the rear roller are connected, and a frame support portion connected to the base portion and supporting a frame of the bicycle. The front roller, the rear roller, and the frame support portion may be movably coupled with respect to the base portion in a length direction and thickness direction of the base portion.

The bicycle simulator may further include a base portion to which both ends of the front roller and both ends of the rear roller are connected, and a first elevating portion for moving a front end of the base portion in a vertical direction perpendicular to the ground, and a second elevating portion for moving a rear end of the base portion in a vertical direction perpendicular to the ground.

The bicycle simulator may further include a first driver for applying a driving force to the first elevating portion and the second elevating portion, and a controller for controlling the first driver.

The bicycle simulator may further include a display unit for visually providing a preset riding environment including an inclined portion to a rider. The controller may control the first driver to apply a driving force to at least one of the first elevating portion and the second elevating portion to correspond to an inclination angle of the inclined portion displayed on the display unit.

The bicycle simulator may further include a first speed measuring portion for calculating a ride speed from rotation of the front wheel, a second speed measuring portion for calculating a ride speed from rotation of the rear wheel, a $(2\text{-}1)^{st}$ driver for applying a rotational force to the front roller, and a $(2\text{-}2)^{nd}$ driver for applying a rotational force to the rear roller.

When the first elevating portion or the second elevating portion moves the base portion in a vertical direction, at least one of the $(2\text{-}1)^{st}$ driver and the $(2\text{-}2)^{nd}$ driver may apply a rotational force to the front roller or the rear roller, wherein a rotation speed of the front wheel or the rear wheel is constant.

The bicycle simulator may further include a belt connected between the front roller and the rear roller and transmitting a rotational force of any one of the front roller and the rear roller to the remaining one.

The bicycle simulator may further include a base portion in which the front roller and the rear roller are rotatably arranged. The belt may be arranged on an outer side portion of the base portion and connect the front roller to the rear roller.

The bicycle simulator may further include an air-blowing device that provides wind, which is variable, to a rider according to a riding speed calculated by at least one of the first speed measuring portion and the second speed measuring portion.

The bicycle simulator may further include a frame support portion for supporting a frame of the bicycle, the frame connecting a front wheel of the bicycle to a rear wheel of the bicycle.

The bicycle simulator may further include an impact relief member arranged below the frame support portion and mitigating an impact applied to a rider.

The first elevating portion and the second elevating portion may each comprise a hollow cylinder, a piston inserted into the hollow cylinder and moving, and a fluid applying pressure to one end of the piston.

The bicycle simulator may further include an input unit for inputting a ride mode and a riding environment.

The input unit may be a terminal device that transmits a query and receives a response by using an artificial intelligence-based chatbot. According to an embodiment of the present disclosure, a method of operating a bicycle simulator includes inputting a ride mode, visually providing a preset riding environment including an inclined portion to a rider according to the ride mode, applying a driving force to at least one of the first elevating portion and the second elevating portion to correspond to an inclination angle of the inclined portion provided in the riding environment, and vertically moving a front end or rear end of the base portion in a direction perpendicular to the ground by a driving force applied from at least one of the first elevating portion and the second elevating portion.

When the riding environment is a flat land, a driving force may not be applied to the first elevating portion and the second elevating portion, and a first support point at which the front roller supports the front wheel and a second support point at which the rear wheel supports the rear wheel may be arranged on the same plane.

The method may further include measuring a rotational speed of the front wheel or rear wheel of the bicycle, and when the first elevating portion or the second elevating portion moves the base portion in a vertical direction, applying a rotational force to the front roller or the rear roller so that a rotation speed of the front wheel or the rear wheel is constant.

The rotational speed of the front wheel or the rear wheel may be measured by a speed measuring portion, and the rotational force applied to the front roller and the rear wheel may be generated by a $(2\text{-}1)^{st}$ driver and a $(2\text{-}2)^{nd}$ driver.

According to the present disclosure, the front and rear wheels of a bicycle are supported on the same plane to match the actual riding environment, and thus, the same state as riding on the actual flat ground may be virtually experienced, and a realistic ride may be thereby enjoyed while excluding unnecessary power.

In addition, by raising or lowering the front end or rear end of a base portion supporting the front roller and the rear roller, the rider on the bicycle may virtually experience various road conditions including an inclined portion, and a dynamic and realistic riding may be thus enjoyed.

Further, when a controller, a speed measuring portion, an air blower, and a display device are organically combined with each other and controllably operated, the rider may be provided with a more realistic and interesting virtual riding environment.

DETAILED DESCRIPTION OF EMBODIMENTS

Figure 1:
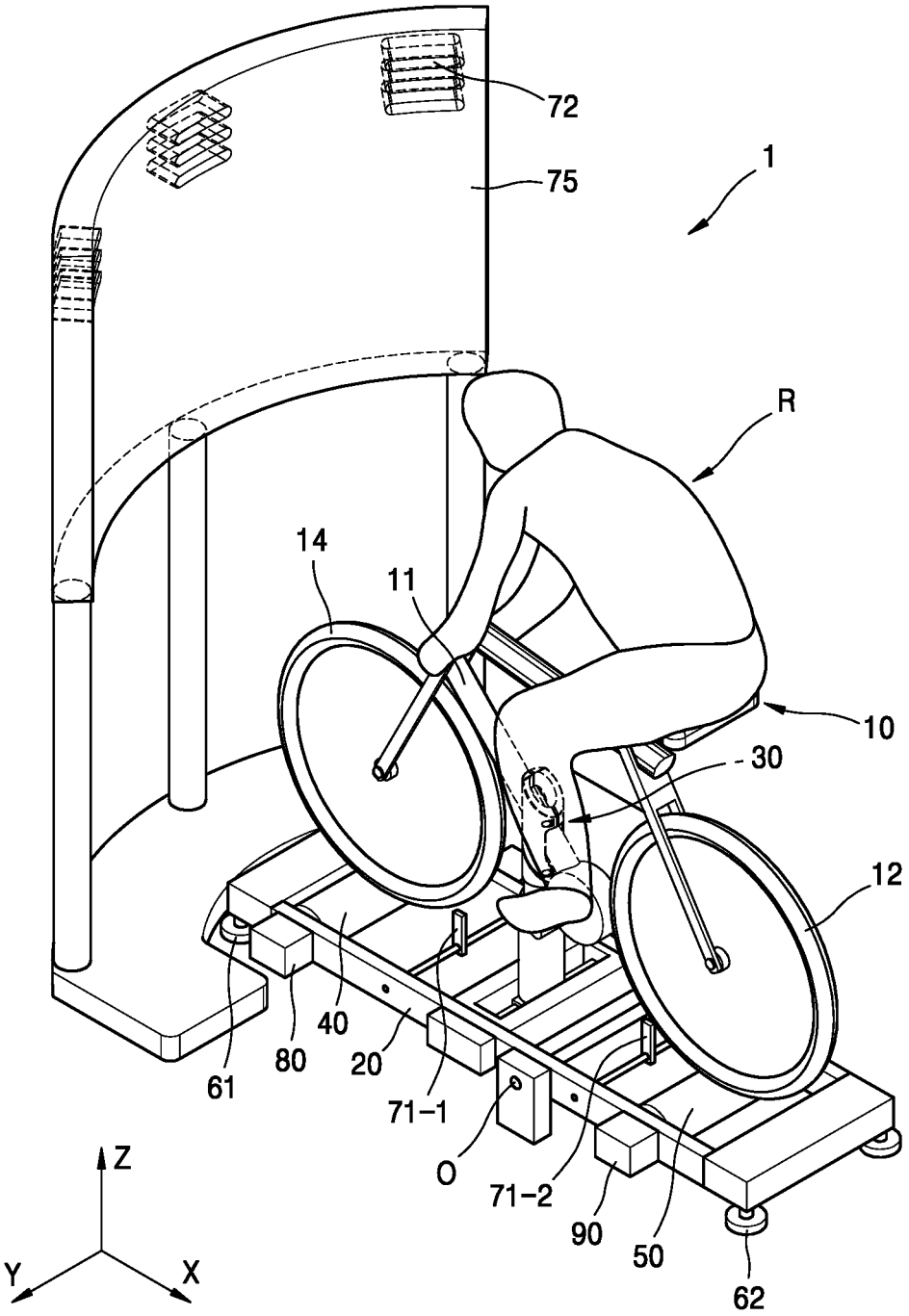
FIG. 1 is a perspective view of a bicycle simulator, according to an embodiment of the present disclosure.

Hereinafter, the following embodiments will be described with reference to the accompanying drawings, wherein like reference numerals refer to like elements throughout and a repeated description thereof is omitted.

As embodiments allow for various changes, example embodiments will be illustrated in the drawings and described in in detail in the written description. Effects and features of the disclosure, and methods for achieving them will be clarified with reference to details described below in detail with reference to the drawings. However, the embodiments are not limited to the following embodiments and may be embodied in various forms.

While such terms as "first," "second," etc., may be used to describe various components, such components are not be limited to the above terms. The above terms are used only to distinguish one component from another.

In the following embodiments, an expression used in the singular encompasses the expression of the plural, unless it has a clearly different meaning in the context.

In the following embodiments, the up (above), down (below), left and right (lateral), front (forward), rear (back), etc. that indicate directions are not intended to limit the rights, but are determined based on the drawings and a relative position between the components, for convenience of explanation. Thus, each direction described below is based on this, except for a case specifically limited otherwise.

In the present specification, it is to be understood that the terms "including," "having," and "comprising" are intended to indicate the existence of the features or components described in the specification, and are not intended to preclude the possibility that one or more other features, numbers, steps, actions, components, parts, or combinations thereof may exist or may be added.

Sizes of components in the drawings may be exaggerated for convenience of explanation. In other words, since sizes and thicknesses of components in the drawings are arbitrarily illustrated for convenience of explanation, the following embodiments are not limited thereto.

Figure 2:
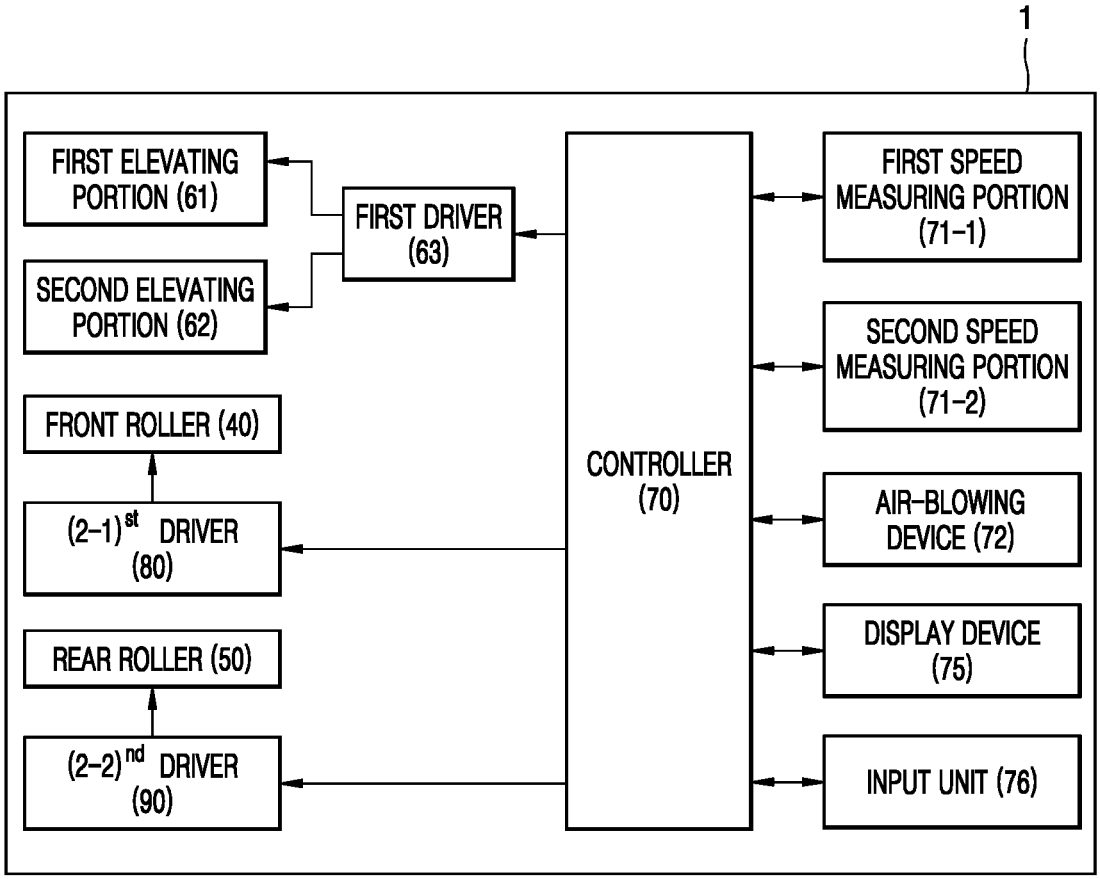
FIG. 2 is a block diagram of a bicycle simulator, according to an embodiment of the present disclosure.
Figure 3:
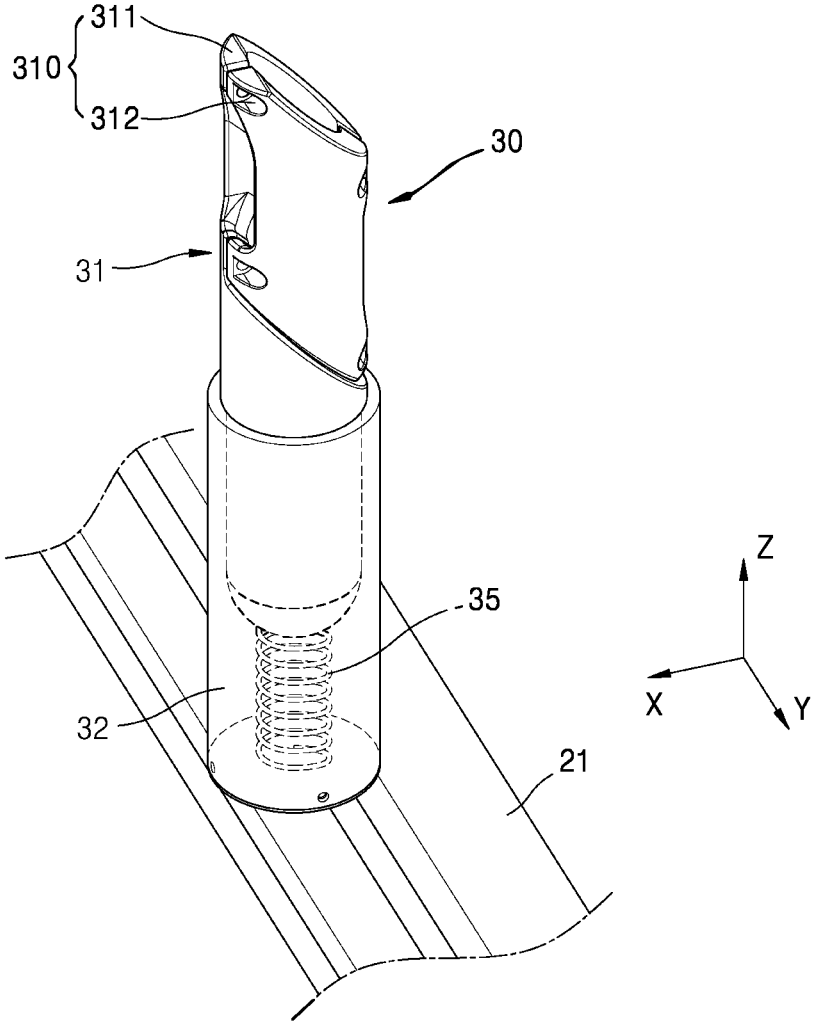
FIG. 3 is a perspective view of a frame support portion, according to an embodiment of the present disclosure.

FIG. 1 is a perspective view of a bicycle simulator, according to an embodiment of the present disclosure. FIG. 2 is a block diagram of the bicycle simulator, according to an embodiment of the present disclosure. FIG. 3 is a perspective view of a frame support portion, according to an embodiment of the present disclosure.

In a bicycle simulator 1 according to an embodiment of the present disclosure, the front wheel and rear wheel of a bicycle 10 supported by the bicycle simulator 1 are supported on the same plane to match the actual riding environment on the flat surface, and a rider Ron the bicycle 10 may thus virtually experience the same state as actually riding on the flat ground, and a realistic ride may be thus enjoyed while excluding unnecessary power.

In addition, by raising or lowering the front end or rear end of a base portion 20 supporting the front roller 40 and the rear roller 50, various road surface conditions including an inclined portion may be virtually experienced and a dynamic and realistic ride may be thus enjoyed.

The bicycle 10 mentioned above not only is specially manufactured for only the bicycle simulator 1 according to an embodiment of the present disclosure, but also is a concept that encompasses all bicycles 10 currently available on the market by various manufacturers. The bicycle 10 may include a bicycle frame 11 constituting the body of the bicycle 10, a front wheel 14 and a rear wheel 12, which are rotatably mounted on the bicycle frame 11, and a drivetrain (crank, chain, transmission, etc.) that converts the pedaling of the rider R to a rotational force of the rear wheel 12.

The bicycle simulator 1 according to an embodiment of the present disclosure may include the base portion 20, a frame support portion 30, the front roller 40, the rear roller 50, a first elevating portion 61, a second elevating portion 62, a first driver 63, a controller 70, first and second speed measuring portions 71-1 and 71-2, an air blowing device 72, a display device 75, a $(2\text{-}1)^{st}$ driver 80, and a $(2\text{-}2)^{nd}$ driver 90, to implement the functions or actions as described above.

Each of the configurations described above will now be described below in detail.

Referring to FIGS. 1 to 3, the base portion 20 according to an embodiment of the present disclosure is a support member fixed to the ground and capable of supporting the bicycle 10. As an example, the base portion 20 may be provided in the shape of a rectangular frame on which the front roller 40 and the rear roller 50 to be described later may be mounted. However, the present disclosure is not limited thereto, and it may be provided with an arbitrary support member on which the front roller 40 and the rear roller 50 may be mounted. In addition, in the base portion 20 according to an example, a support frame 21 to which the frame support portion 30 may be fixed may be arranged across either side of the base portion 20.

The frame support portion 30 is a support member that is detachably coupled to the bicycle frame 11 and stably fixes a position of the bicycle 10. As an example, the frame support portion 30 may include a support bar 31 and a fixed support portion 32, the support bar 31 being a linear rod-shaped support member extending in one direction.

A clamp device 310 is arranged at one end of the support bar 31 to be detachably coupled to one side (downtube) of the bicycle frame 11. In this case, the clamp device 310 may include a first clamp 311 and a second clamp 312, which may be detachably coupled to one side (downtube) of the bicycle frame 11. As an example, the clamp device 310 may be provided in a detachable form. Accordingly, the clamp device 310 may be replaced according to the type of the bicycle 10 that is mounted, to support the bicycle 10. In addition, the clamp device 310 may use an electromagnet, and a locking device having shapes that correspond to each other, or may be implemented as a screw locking device in a male and female form, to support one side of the bicycle frame 11 that is mounted. As an example, the clamp device 310 may be provided to have a specific magnetic force, for example, S-pole or N-pole magnetic force. In this case, a fitting portion (not shown) having a magnetic force different from that of the clamp device 10 may be arranged in the bicycle frame 11. Accordingly, the bicycle frame 11 may be supported by the clamp device 310 in a non-contact manner. However, the present disclosure is not limited thereto, and the clamp device 310 may be implemented as a locking device of other types that is capable of supporting one side of the bicycle frame 11.

The fixed support portion 32 may be provided in a hollow rod shape so that the other end of the support bar 31 may be inserted thereinto. As an example, one end of the fixed support portion 32 may be arranged to be fixed to the support frame 21 provided in the base portion 20. In addition, the other end of the fixed support portion 32 is arranged such that the support bar 31 is inserted thereinto, so that the support bar 31 may be guided to move in the z-axis direction.

An impact relief member 35 may be arranged at the other end of the support bar 31 to mitigate the impact applied to the rider R. As an example, the impact relief member 35 may be provided as an elastic member and inserted into the fixed support portion 32. At this time, one end of the impact relief member 35 may support the other end of the support bar 31, and thus, the impact applied to the rider R in the z-axis direction may be mitigated.

The front roller 40 is a rod-shaped component that supports the front wheel 14 of the bicycle 10 mounted on the bicycle simulator 1 and rotates together with the rotation of the front wheel 14, wherein either end of the front roller 40 may be connected to the base portion 20 so that it may be freely rotate forward or backward based on the bicycle 10 that is mounted.

The rear roller 50 is a rod-shaped component that supports the rear wheel 12 of the bicycle 10 mounted on the bicycle simulator 1 and rotates together with the rotation of the rear wheel 12, and either end of the rear roller 50 may be connected to the base portion 20 so that it may be freely rotate forward or backward based on the bicycle 10 that is mounted.

The front roller 40 and the rear roller 50 as described above may be of any shape that is capable of being in contact with the front wheel 14 and the rear wheel 12 and rotating together as the front wheel 14 and the rear wheel 12 rotate. Accordingly, the longitudinal sections of the front roller 40 and the rear roller 50 may be polygonal, elliptical, or circular. At this time, the front wheel 14 and the rear wheel 12 of the bicycle 10 may freely move on the upper surfaces of the front roller 40 and the rear roller 50, respectively.

As an example, the front roller 40 and the rear roller 50 according to the present disclosure may each include a circular longitudinal section so that smooth rotation is possible according to the rotation of the front wheel 14 and the rear wheel 12 without a heterogeneous feeling of ride given to the rider R who rotates the front wheel 14 and the rear wheel 12.

The first elevating portion 61 is a driving device capable of vertically moving the front end of the base portion 20 in a direction perpendicular to the ground, for example, the z-axis direction. The second elevating portion 62 is a moving device that is capable of vertically moving the rear end of the base portion 20 in a direction perpendicular to the ground, for example, the z-axis direction. In this case, the first elevating portion 61 and the second elevating portion 62 may receive driving force through the first driver 63 controlled by the controller 70. The base portion 20 may be rotated about a rotation axis O by the first elevating portion 61 and the second elevating portion 62 described above. Accordingly, an angle of inclination of the bicycle 10 mounted on the base portion 20 may be adjusted in various ways. More details related to this will be described later below with reference to FIGS. 6 to 8B.

The controller 70 may be hardware that controls the overall functions and operations of the bicycle simulator 1. The controller 70 may be implemented in the form of a single microprocessor module or may be implemented in the form of a combination of two or more microprocessor modules. That is, the controller 70 is not limited by any one implementation form.

The first speed measuring portion 71-1 is a component that calculates a ride speed from the size of the circumference of the front wheel 14 and the number of revolutions of the front wheel 14 per unit time, and may be installed in a location adjacent to the front wheel 14 to accurately count the number of rotations of the front wheel 14. The second speed measuring portion 71-2 is a component that calculates a ride speed from the size of the circumference of the rear wheel 12 and the number of rotations of the rear wheel 12 per unit time, and may be installed in a location adjacent to the rear wheel 12 to accurately count the number of rotations of the rear wheel 12.

The air blowing device 72 is a component for providing wind, which is variable, to the rider R according to a ride speed calculated in the first and second speed measuring portions 71-1 and 71-2, and a pair of air blowing devices 72 may be provided at the upper left and right sides of the display device 75 to be described later below while being oriented toward the rider R. The ride speed calculated in real time from the first and second speed measuring portions 71-1 and 71-2 as described above may be ride information for a specific area or course of a bicycle competition selected by the rider R, and transmitted to the controller 70. In addition, the controller 70 that receives the ride speed operates and controls the air-blowing device 72 with an intensity corresponding to the speed, thereby providing the rider R with a dynamic and realistic ride experience.

The display device 75 is a component that visually conveys a riding environment for a course of a bicycle competition or an operating system program to the rider R, and may be a display device 75 having a curved shape of a size that covers all of the front viewing angle of the rider R as shown in FIG. 1, or a goggle-type display device (not shown) worn by the rider R. As an example, when the display device 75 realistically displays a preset riding environment, etc., the rider R may adjust, in various ways, an inclination angle of the bicycle 10 based on road condition information corresponding to the riding environment provided in real time.

An input unit 76 may receive an input of the rider R for controlling the bicycle simulator 1. As an example, the input unit 76 may be a terminal that transmits a query and receives a response by using an artificial intelligence-based chatbot. Here, the input unit 76 may be implemented as a computer, which is capable of accessing a remote server or terminal through a network. Here, the computer may include, for example, a navigation, a notebook PC equipped with a web browser, a desktop, a laptop, and the like. In this case, the input unit 76 may be implemented as a terminal, which is capable of accessing a remote server or terminal through a network. The input unit 76 may be, for example, a wireless communication device in which portability and mobility is guaranteed, including a handheld wireless communication device of all types, such as navigations, Personal Communications System (PCS), Global System for Mobile communications (GSM), Personal Digital Cellular (PDC), Personal Handy-phone System (PHS), Personal Digital Assistant (PDA), International Mobile Telecommunication (IMT)-2000, Code Division Multiple Access (CDMA)-2000, W-CDMA, wireless broadband Internet (Wibro) terminals, smartphones, smartpads, tablet personal computers (PC), and the like. In this case, the controller 70 may perform a function of a server of providing a web page, app page, program, or application for an intelligent chatbot-based interactive field support service. For example, the controller 70 may be a server that maps a plurality of scenarios to answers to each scenario in advance and stores them in a chatbot database. In addition, the controller 70 may be a server that, when the input unit 76 makes a question or request, analyzes the request or question and provides a preset answer, or may be a server that, when the chatbot database has no answer, transmits the request or question to an administration terminal. In addition, the controller 70 may be a server that performs training as to queries and answers after classifying and clustering them through collection, preprocessing, and analysis. In this case, the controller 70 may be a server that proceeds with data learning by using a deep learning artificial neural network algorithm.

In addition, the input of the rider R using the input unit 76 may include input to manipulate buttons, key pads, a mouse, a trackball, a jog switch, a knob, etc., input to touch a touch pad or touch screen, voice input, motion input, biometric information input (e.g., iris recognition, fingerprint recognition, etc.), but is not limited thereto. For example, when the input unit 76 inputs an input signal by the voice input method, when the rider R is a visually-impaired person, or when two hands of the rider R are fixed to the handle bars and thus cannot be used, an input signal related to a ride mode, etc. may be transmitted to the controller 70.

The (2-1)st driver 80 and the (2-2)nd driver 90 are each a driving device capable of applying the rotational force to either the front roller 40 or the rear roller 50 according to the rotational speed of the front wheel 14 and the rear wheel 12 that are calculated in the first and second speed measuring portions 71-1 and 71-2. According to a ride mode to be described later below, an inclination angle of the bicycle 10 may be adjusted in various ways. At this time, the controller 70 operably controls the (2-1)st driver 80 and (2-2)nd driver 90 such that the rotation speed of the front roller 40 is equal to that of the rear roller 50, thereby providing a stable ride experience to the rider R.

Figure 4A:
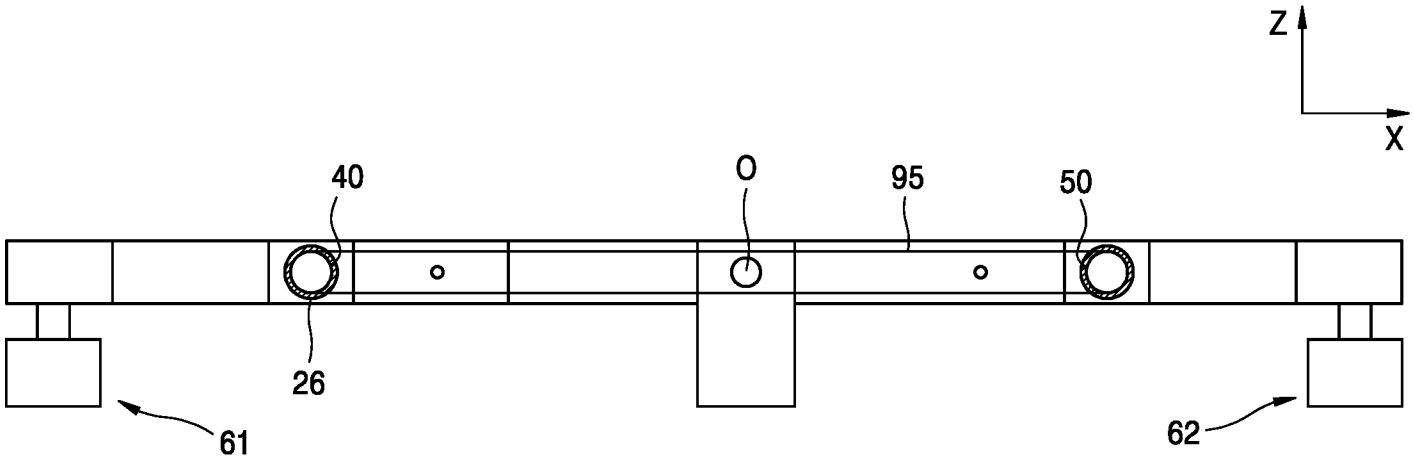
FIG. 4A is a side view of a bicycle simulator, according to another embodiment of the present disclosure.
Figure 4B:
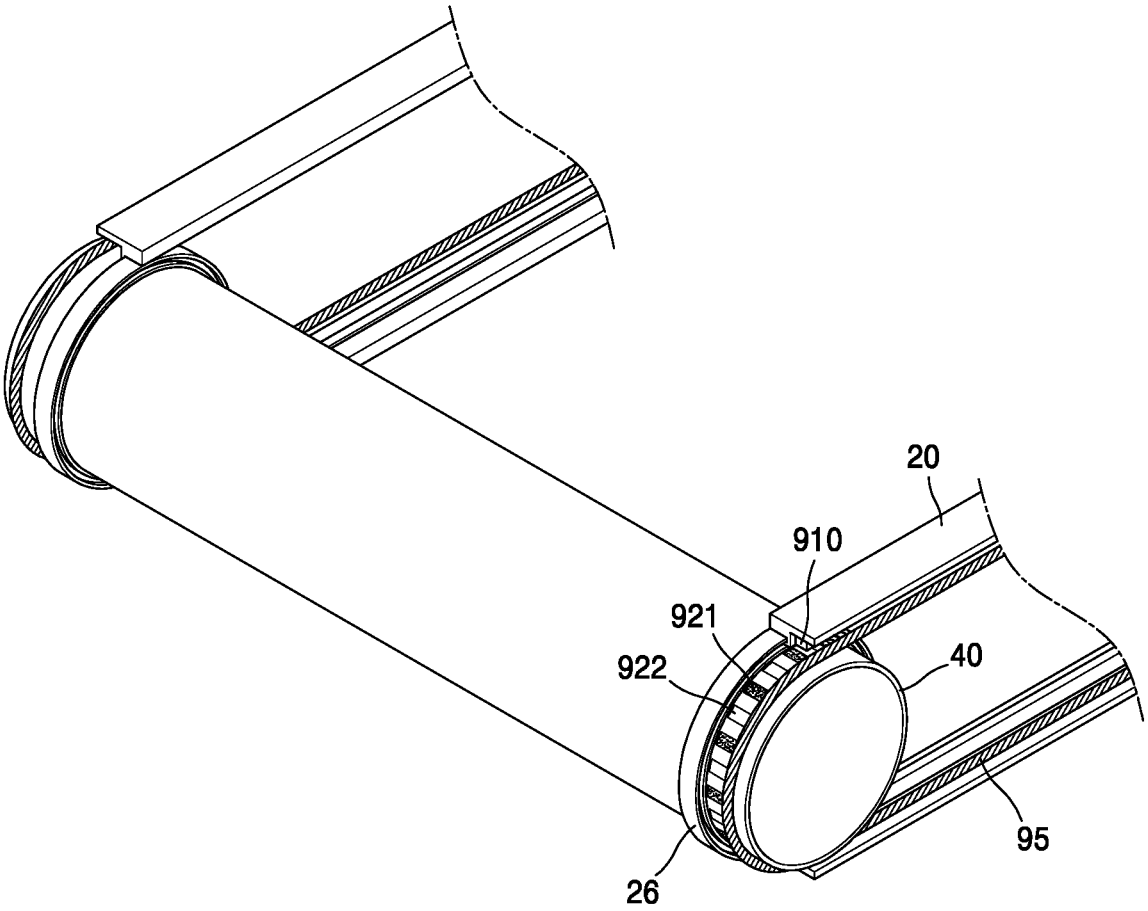
FIG. 4B is a partial perspective view of the bicycle simulator shown in FIG. 4A.

FIG. 4A is a side view of the bicycle simulator, according to another embodiment of the present disclosure. FIG. 4B is a partial perspective view of the bicycle simulator shown in FIG. 4A.

According to another embodiment of the present disclosure, a belt 95, which connects the front roller 40 to the rear roller 50, may be arranged between the front roller 40 and the rear roller 50, as shown in FIGS. 4A and 4B. As an example, when the rider rotates the rear wheel 12 of the bicycle 10 that is mounted, the rear roller 50 may also be rotated by the rotational force of the rear wheel 12. At this time, the rotational force of the rear roller 50 may be transmitted to the front roller 40 through the belt 95. Accordingly, the rotational speed of the front roller 40 is formed equal to that of the rear roller 50, thus providing a stable ride experience to the rider R. As an example, the belt 95 may be arranged on an outer side portion of the base portion 20 for convenience of replacement and maintenance. At this time, by using a bearing portion 26 arranged along the outer circumferential surfaces of the front roller 40 and the rear roller 50, the front roller 40 and the rear roller 50 may rotate about the base portion 20 without a separate rotation axis. In addition, at this time, the belt 95 may be wound along the outer circumferential surfaces of the front roller 40 and the rear roller 50 and may transmit the rotational force to the front roller 40 and the rear roller 50.

A rotational speed detection portion 910 according to an embodiment of the present disclosure may be implemented as a magnetic encoder including a magnetic flux sensor. As an example, permanent magnets 921 and 922 having different poles from each other are alternately magnetized along the outer circumferential surface of the front roller 40. At this time, the permanent magnets 921 and 922 may be formed of an integral type in which half of the front roller 40 is formed with an N pole 921 and the other half is formed with an S pole, or may be formed as a plurality of independent permanent magnets arranged at regular intervals along the outer circumferential surface. The rotational speed detection portion 910 may detect the flux linkage of the permanent magnets 921 and 922 with respect to the rotational speed detection portion 910 that regularly changes as the front roller 40 rotates, and output it as an electrical signal. Thereafter, the output signal is applied to the controller 70, and the rotation of the front roller 40 may be detected. In an embodiment of the present disclosure, the rotational speed detection portion 910 is exemplified as a magnetic encoder including a magnetic flux sensor, but present disclosure is not limited thereto. As an example, the rotational speed detection portion 910 may be implemented as an optical encoder including a light source and a light-receiving unit, wherein a reflective member capable of reflecting light incident from the light source may be arranged on the outer circumferential surface of the front roller 40. In addition, the rotational speed detection portion 910 may be arranged to be fixed to the base portion 20 or may be implemented in a form detachably attached to the base portion 20 by a user. In addition, the rotational speed detection portion 910 according to an example may be arranged on the rear roller 50 as well as the front roller 40 or may be arranged on both the front roller 40 and the rear roller 50.

As described above, the first speed measuring portion 71-1 and the second speed measuring portion 71-2 may calculate a ride speed from the circumference sizes of the front wheel 14 and the rear wheel 12 and the number of revolutions of the front wheel 14 and the rear wheel 12 per unit time. The $(2\text{-}1)^{st}$ driver 80 and the $(2\text{-}2)^{nd}$ driver 90 may apply the rotational force to the front roller 40 or the rear roller 50 by detecting the difference between the rotational speed of the front wheel 14 and the rear wheel 12 calculated by the first and second speed measuring portions 71-1 and 71-2 and the rotational speed of the front roller 40 and the rear roller 50 measured from the rotational speed detection portion 910. At this time, the controller 70 may adjust the rotational speed of the front roller 40 and the rear roller 50 to correspond to the rotational speed of the front wheel 14 and the rear wheel 12, and thus, a stable ride experience may be provided to the rider R.

Figure 5:
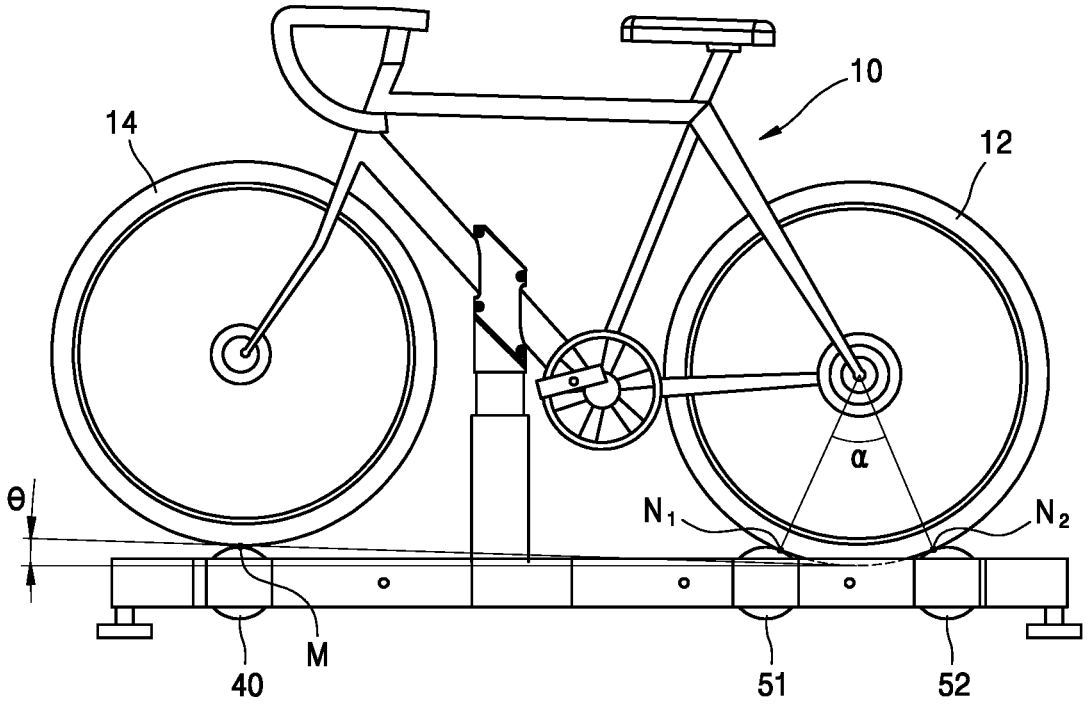
FIG. 5 is a side view of a bicycle simulator, according to the related art.
Figure 6A:
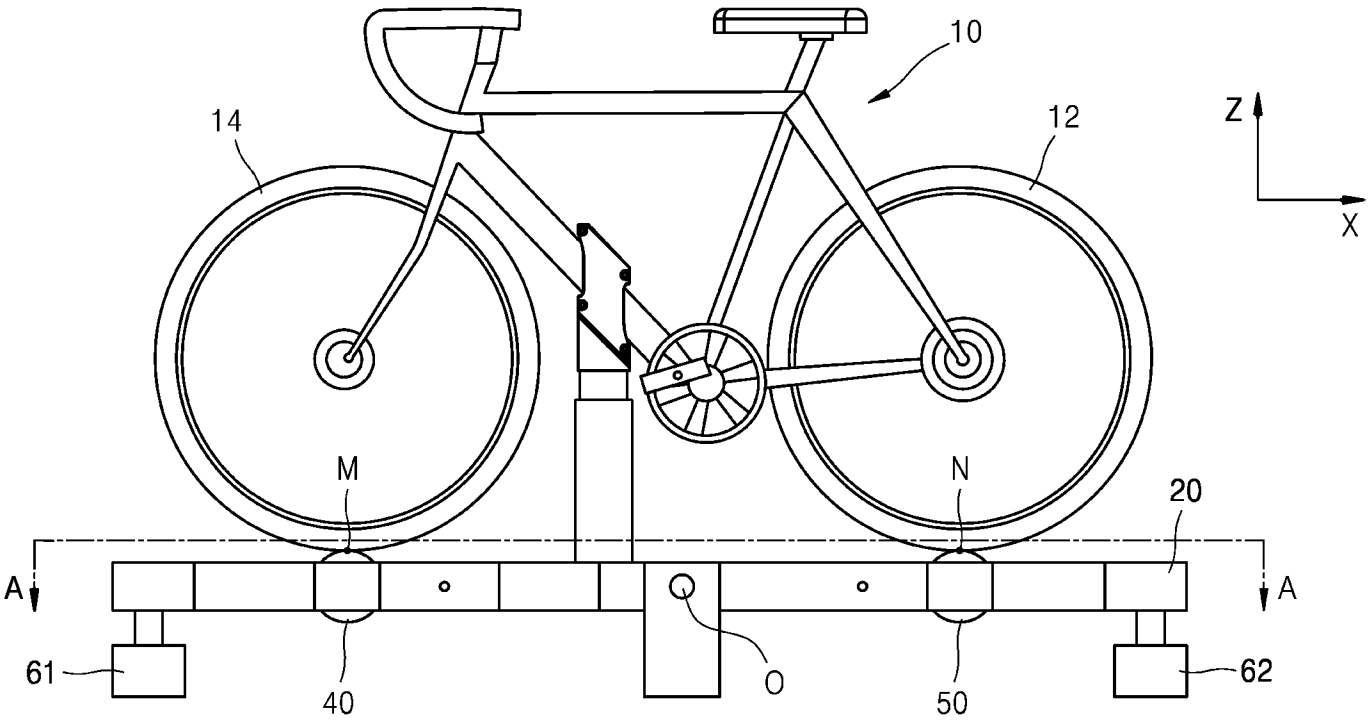
FIG. 6A is a side view of a bicycle simulator, according to an embodiment of the present disclosure.
Figure 6B:
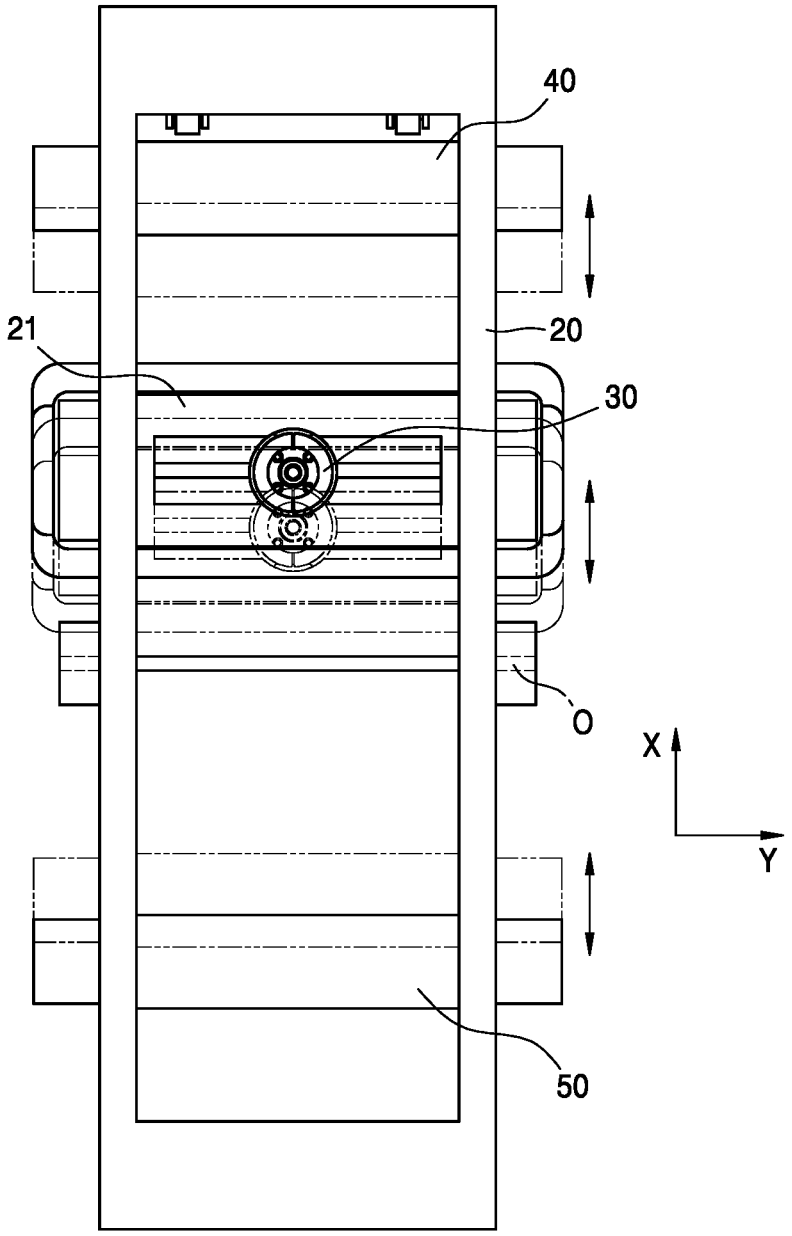
FIG. 6B is a plan view of a bicycle simulator, according to an embodiment of the present disclosure.
Figure 6C:
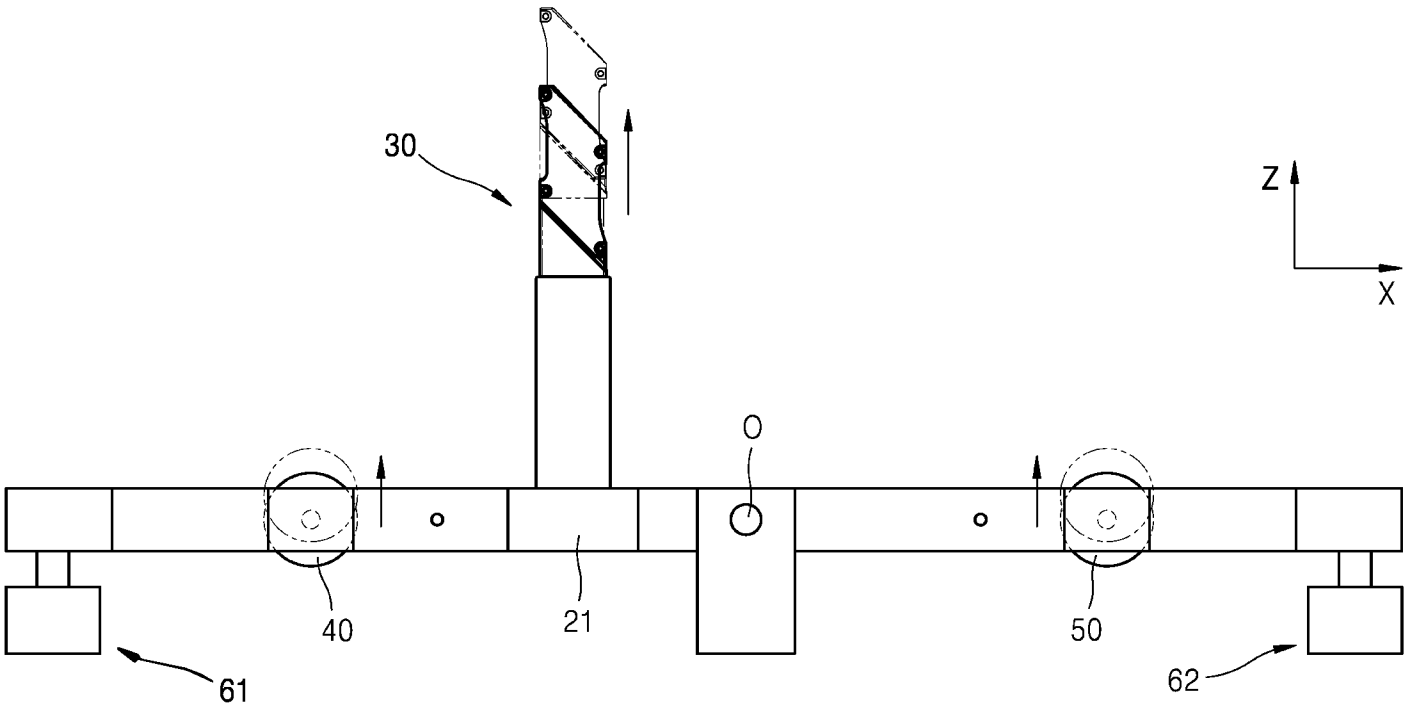
FIG. 6C is a side view of a bicycle simulator, according to an embodiment of the present disclosure.

FIG. 5 is a side view of a bicycle simulator, according to the related art. FIG. 6A is a side view of a bicycle simulator, according to an embodiment of the present disclosure. FIG. 6B is a plan view of the bicycle simulator, according to an embodiment of the present disclosure. FIG. 6C is a side view of a bicycle simulator, according to an embodiment of the present disclosure. Referring to FIG. 5, the front wheel 14 of the bicycle 10 mounted on a related-art bicycle simulator is supported by one point by using one front roller 40. In addition, the rear wheel 12 is supported by two points by using two rear rollers 51 and 52 that rotate and support the rear wheel 12 from the lower side to the front and rear directions. At this time, while a support point M of the front wheel 14 is at the lowermost end of the front wheel 14, support points N1 and N2 of the rear wheel 12 are not at the lowermost end of the rear wheel 12, and thus, an inclined portion having a preset angle θ may be formed between the lowermost end of the front wheel 14 and the lowermost end of the rear wheel 12. Thereby, the rider R may experience the same riding condition as if riding uphill that substantially has a preset angle θ instead of a flat ground.

On the other hand, referring to FIG. 6A, the front wheel 14 of the bicycle 10 mounted on the bicycle simulator 1 according to an embodiment of the present disclosure is supported by one point by using one front roller 40. In addition, the rear wheel 12 is supported by one point by using one rear roller 50. At this time, the support point M of the front wheel 14 may be at the lowermost end of the front wheel 14, and a support point N of the rear wheel 12 may also be at the lowermost end of the rear wheel 12. Accordingly, the lowermost end of the front wheel 14 and the lowermost end of the rear wheel 12 may be arranged on the same plane, and thus, the rider R may experience the same riding condition as if riding on a substantially flat ground. In addition, unlike the prior art, in the present disclosure, the rear wheel 12 is supported by one point instead of two points, and thus, loss of kinetic energy due to friction that may occur from the two points of support may be prevented.

As an example, the frictional resistance $F_{fric1}$ applied to the rear wheel 12 of the bicycle 10 mounted on the related-art bicycle simulator shown in FIG. 5 may be expressed as in Equation (1) shown below. Here, C is a coefficient of friction, W is a normal force, and α is an angle between the two points of support.

$$F_{fric1} = \frac{C * W}{\cos\alpha/2} \quad \text{Equation (1)}$$

On the other hand, the frictional resistance $F_{fric2}$ applied to the rear wheel 12 of the bicycle 10 mounted on the related-art bicycle simulator according to an embodiment of the present disclosure may be expressed as in Equation (2) shown below. Here, C is a coefficient of friction and W is a normal force.

$$F_{fric2}=C*W \quad \text{Equation (2)}$$

The frictional resistance $F_{fric}$ applied to the bicycle 10 mounted on the bicycle simulator may be proportional to the normal force W that is applied by the rear wheel 12 to the rear roller 50. At this time, in the bicycle 10 mounted on a bicycle simulator according to an embodiment of the present disclosure, the normal force may be reduced by about 40% to about 50% compared to the bicycle 10 mounted on a related-art bicycle simulator. Therefore, unnecessary frictional resistance may be reduced, and the sense of reality of riding may be thus improved.

As described above, when the support point M of the front wheel 14 is at the lowest end of the front wheel 14, and the support point N of the rear wheel 12 is also at the lowest end of the rear wheel 12, the frictional resistance $F_{fric}$ applied to the bicycle 10 mounted on the bicycle simulator may be minimized. However, the positions of the front wheel 14 and the rear wheel 12 vary depending on the size and type of the bicycle 10 to be mounted, and thus, the support point M of the front wheel 14 and the support point N of the rear wheel 12 may not be placed at the lowermost end of the front wheel 14 and the rear wheel 12, respectively.

Taking into account such a problem, in an embodiment of the present disclosure, the components on which the bicycle 10 is mounted and supported, for example, the front roller 40, the rear roller 50, and the frame support portion 30 supported on the support frame 21, may move with respect to the base portion 20 in the length and thickness directions of the base portion 20, for example, the x-axis and z-axis directions, as shown in FIGS. 6B and 6C. Accordingly, by moving the positions of the front roller 40, rear roller 50, and the support frame 21 in one direction, for example, in the x-axis or z-axis, according to the size and type of the bicycle 10 that is mounted, the support point M of the front wheel 14 and the support point N of the rear wheel 12 may be placed at the lowermost ends of the front wheel 14 and the rear wheel 12, respectively. Thus, the lowermost end of the front wheel 14 and the lowermost end of the rear wheel 12 may be arranged on the same plane, and thus, the rider R may experience the same riding condition as if riding on a substantially flat ground and the loss of kinetic energy due to unnecessary frictional force may be prevented. In addition, the front roller 40, the rear roller 50, and the structure below the support frame 21 may be repaired more easily.

Figure 7:
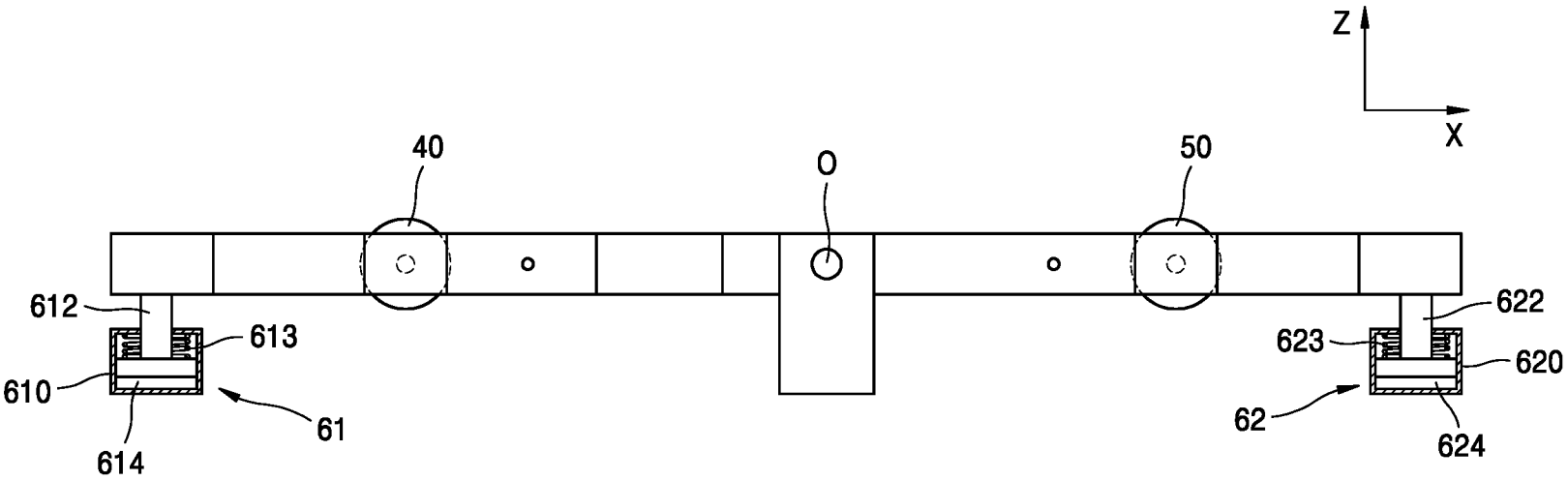
FIG. 7 is a side cross-sectional view of the bicycle simulator according to an embodiment of the present disclosure, taken along line A-A shown in FIG. 6A.

FIG. 7 is a side cross-sectional view of the bicycle simulator according to an embodiment of the present disclosure, taken along line A-A shown in FIG. 6A.

The bicycle simulator 1 according to an embodiment of the present disclosure may adjust an inclination angle δ of the bicycle 10 mounted on the bicycle simulator 1 by rotating the base portion 20 about one axis O. Accordingly, the rider R on the bicycle 10 may experience the same riding condition as if riding downhill or uphill. As an example, as shown in FIG. 7, the first elevating portion 61 may include a hydraulic cylinder 610 of a hollow type, a piston 612, an elastic member 613, and a fluid 614. The hydraulic cylinder 610 is a cylinder member that is connected in fluid communication with the first driver 63 controlled by the controller 70, for example, a hydraulic pump, so that the pressure of the fluid 614 transmitted from the hydraulic pump may be transmitted to one end of the piston 612, and may guide a reciprocating movement of the piston 612 while maintaining a sealed state with the other end of the piston 612. At this time, at least one elastic member 613 for elastically supporting the piston 612 inward with respect to the hydraulic cylinder 610 may be provided between the hydraulic cylinder 610 and the piston 612. When the operation of the first driver 63 is stopped, the elastic member 613 may return the piston 612 downward so as not to provide the fluid 614 into the hydraulic cylinder 610.

The second elevating portion 62 may include a hydraulic cylinder 620 of a hollow type, a piston 622, an elastic member 623, and a fluid 624. The configuration and operation of the second elevating portion 62 are substantially the same as those of the first elevating portion 61, and thus, the description thereof is omitted here for convenience.

As described above, the piston 612 provided in the first elevating portion 61 and the piston 622 provided in the second elevating portion 62 may rise or fall in a direction perpendicular to the ground, that is, in the z-axis direction, by the first driver 63 controlled by the controller 70. Accordingly, the front end of the base portion 20 that is supported by the piston 612 provided in the first elevating portion 61 may also rise or fall in the z-axis direction. In addition, the rear end of the base portion 20 that is supported by the piston 622 provided in the second elevating portion 62 may also rise or fall in the z-axis direction. As the front end or the rear end of the base portion 20 rises or falls, the base portion 20 may rotate about the one axis O, thus adjusting the inclination angle δ of the bicycle 10 mounted on the bicycle simulator 1.

Below, the bicycle simulator 1 in which, by adjusting the inclination angle δ of the bicycle 10 mounted in the bicycle simulator 1 in conjunction with the display device 75, various riding conditions may be experienced not only visually but also with the whole body, and a more dynamic and exciting ride may be enjoyed is described in greater detail.

Figure 8A:
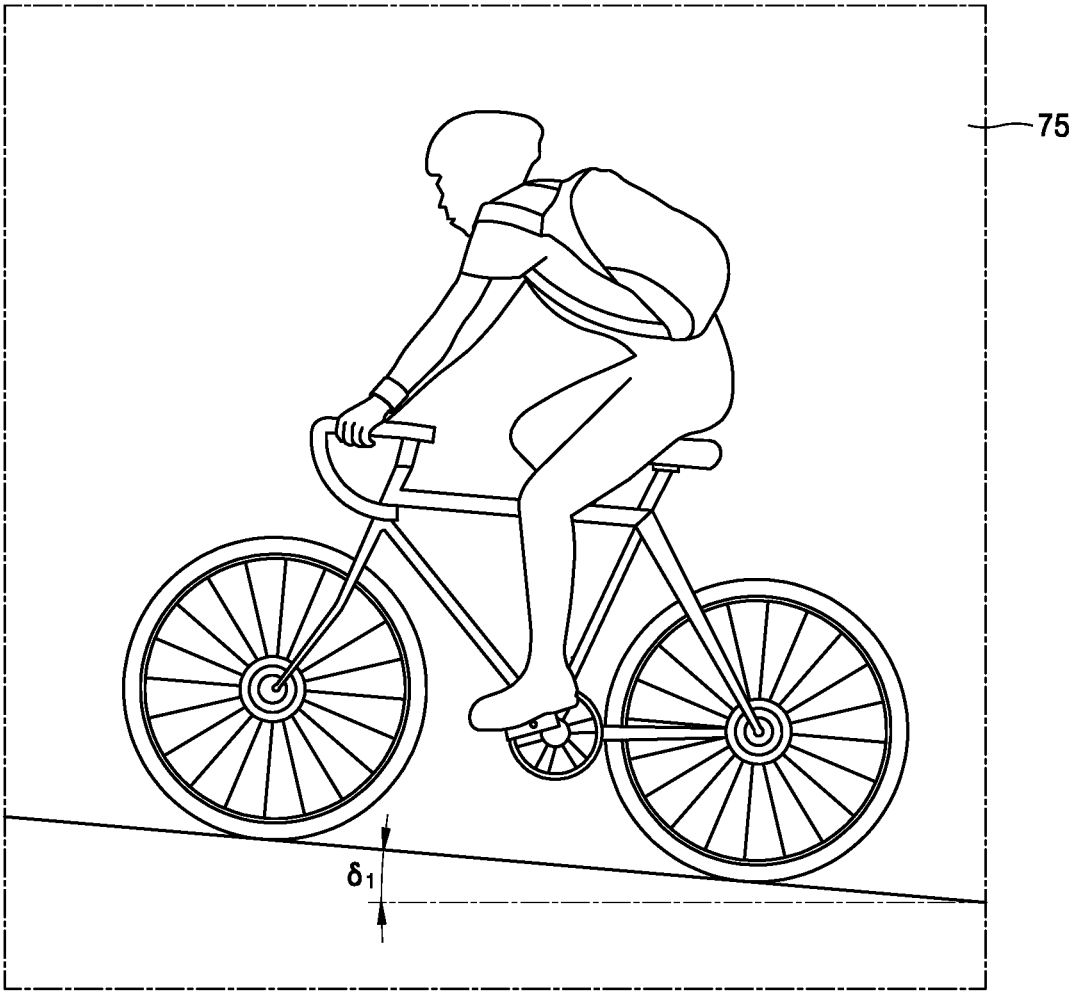
FIG. 8A is a schematic diagram of a display device in which a ride scene including an inclined portion is displayed, according to an embodiment of the present disclosure.
Figure 8B:
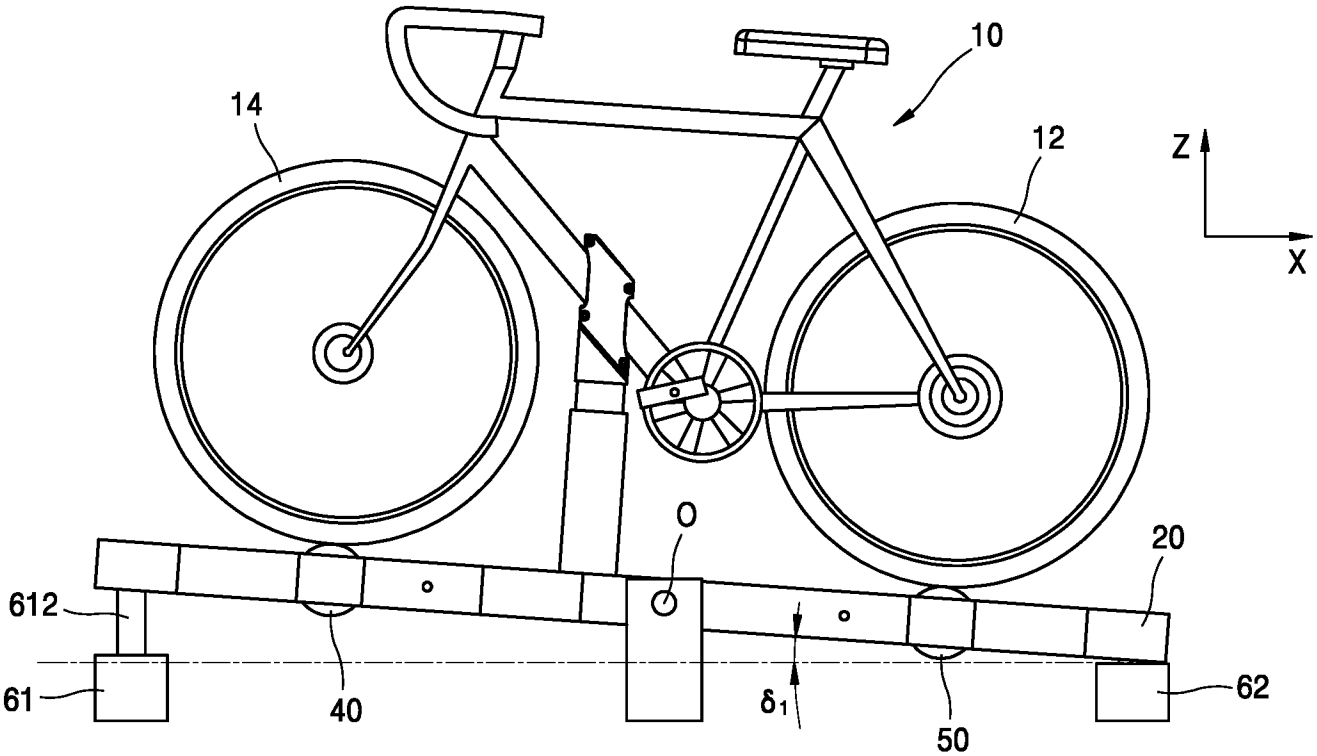
FIG. 8B is a side view of a bicycle simulator, according to an embodiment of the present disclosure.
Figure 9A:
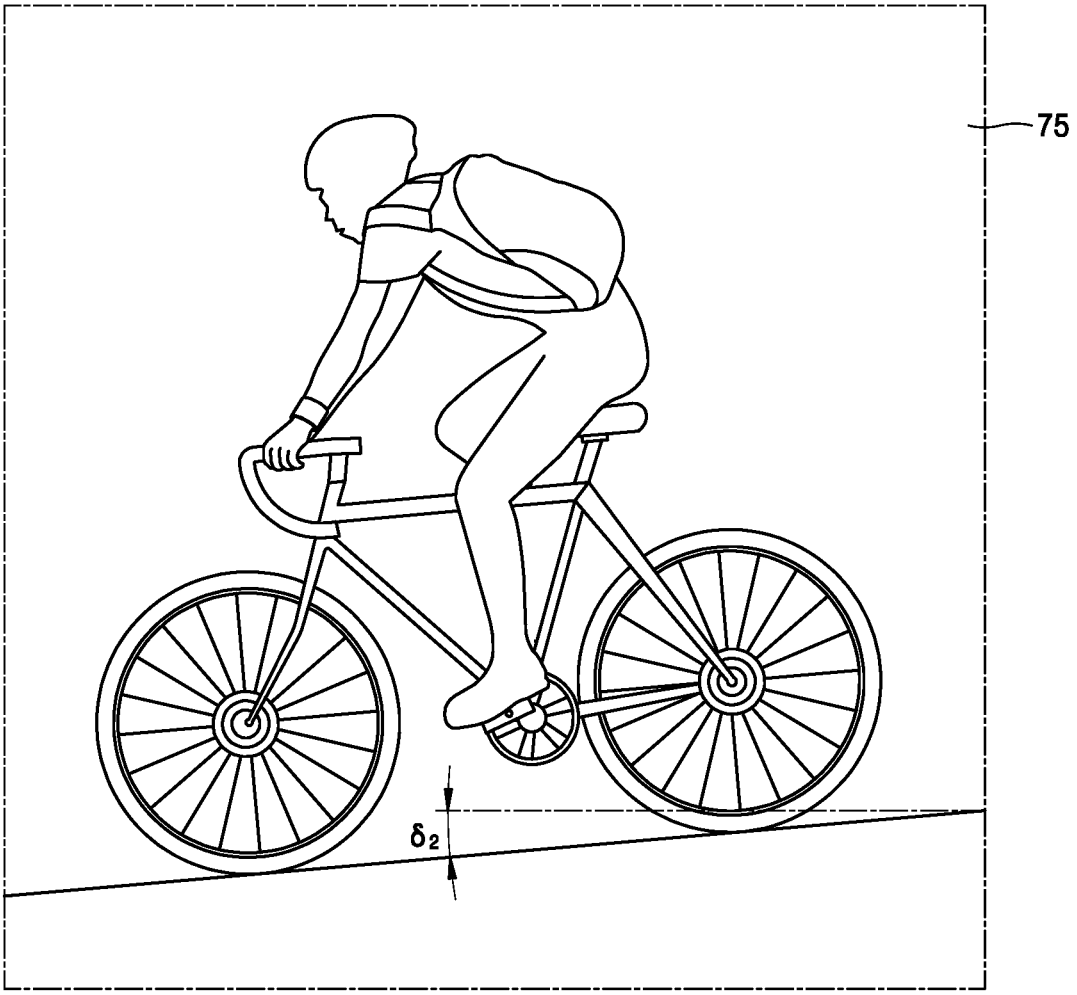
FIG. 9A is a schematic diagram of a display device in which a ride scene including an inclined portion is displayed, according to an embodiment of the present disclosure.
Figure 9B:
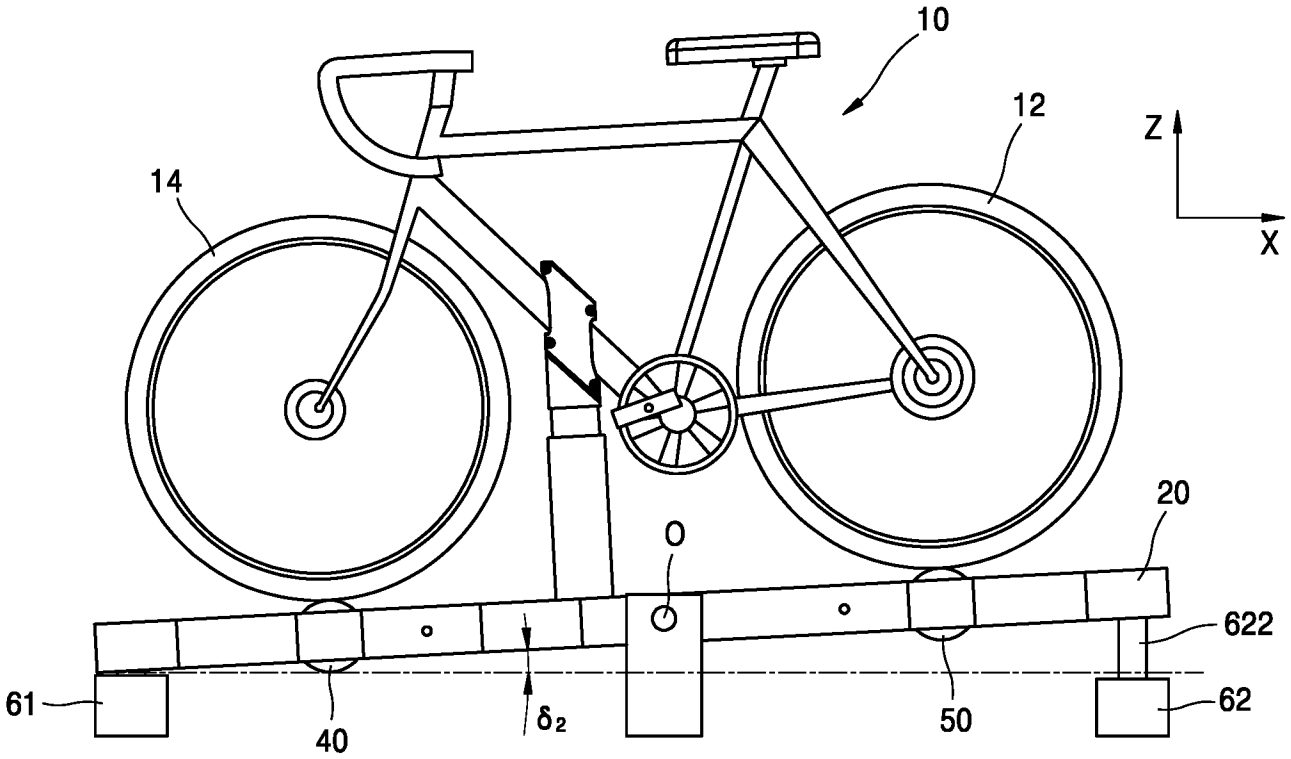
FIG. 9B is a side view of a bicycle simulator, according to an embodiment of the present disclosure.

FIG. 8A is a schematic diagram of a display device in which a ride scene including an inclined portion is displayed, according to an embodiment of the present disclosure. FIG. 8B is a side view of a bicycle simulator, according to an embodiment of the present disclosure. FIG. 9A is a schematic diagram of a display device in which a ride scene including an inclined portion is displayed, according to an embodiment of the present disclosure. FIG. 9B is a side view of the bicycle simulator, according to an embodiment of the present disclosure.

Referring to FIG. 8A, a state of the rider R riding a bicycle on an inclined road with a first inclination angle δ1 may be displayed on the display device 75. As an example, such a ride route may be an implementation of an uphill road of a mountain bike ride route. In this case, the controller 75, after recognizing the riding condition implemented in the display device 75, may manipulate the first driver 63 to respond to the riding condition. As an example, as shown in FIG. 8B, the piston 612 provided in the first elevating portion 61 may rise in the z-axis direction by the operation of the first driver 63. Accordingly, the front end of the base portion 20 supported by the piston 612 may also rise in the z-axis direction, and thus, the base portion 20 may be inclined at the first inclination angle δ1 with respect to the ground.

Accordingly, the bicycle 10 supported on the base portion 20 may also be arranged at the first inclination angle δ1 with respect to the ground, and the rider R may more safely enjoy a dynamic experience in an indoor space as if he or she is riding on a mountain road with an inclination angle.

In addition, when the bicycle 10 supported by the bicycle simulator 1 is arranged at a first inclination angle $\delta_1$ with respect to the ground to implement an uphill ride as described above, the rotation speed of the front wheel 14 and the rear wheel 12 may not be constant. In this case, the first speed measuring portion 71-1 and the second speed measuring portion 71-2 may measure the rotation speeds of the front wheel 14 and the rear wheel 12 and transmit the measurement to the controller 70. When the rotation speeds of the front wheel 14 and the rear wheel 12 do not match each other, the controller 70 may control the $(2\text{-}1)^{st}$ driver 80 and $(2\text{-}2)^{nd}$ driver 90 to apply the rotational force to one or more of the front roller 40 or the rear roller 50. Accordingly, the rotation speeds of the front wheel 14 and the rear wheel 12 may match each other, and the rider R may experience the same riding condition as the actual riding.

Referring to FIG. 9A, a state of the rider R riding a bicycle on an inclined road with a second inclination angle $\delta_2$ may be displayed on the display device 75. As an example, such a ride route may be an implementation of a downhill of a mountain ride route. In this case, the controller 70, after recognizing the riding condition implemented in the display device 75, may manipulate the first driver 63 to respond to the riding condition. The technical feature of implementing a downhill ride by using the controller 70, the first driver 63, and the second elevating portion 62 are substantially the same as the technical feature of implementing an uphill ride shown in FIGS. 8A and 8B, and thus a description thereof will be omitted herein.

Figure 10:
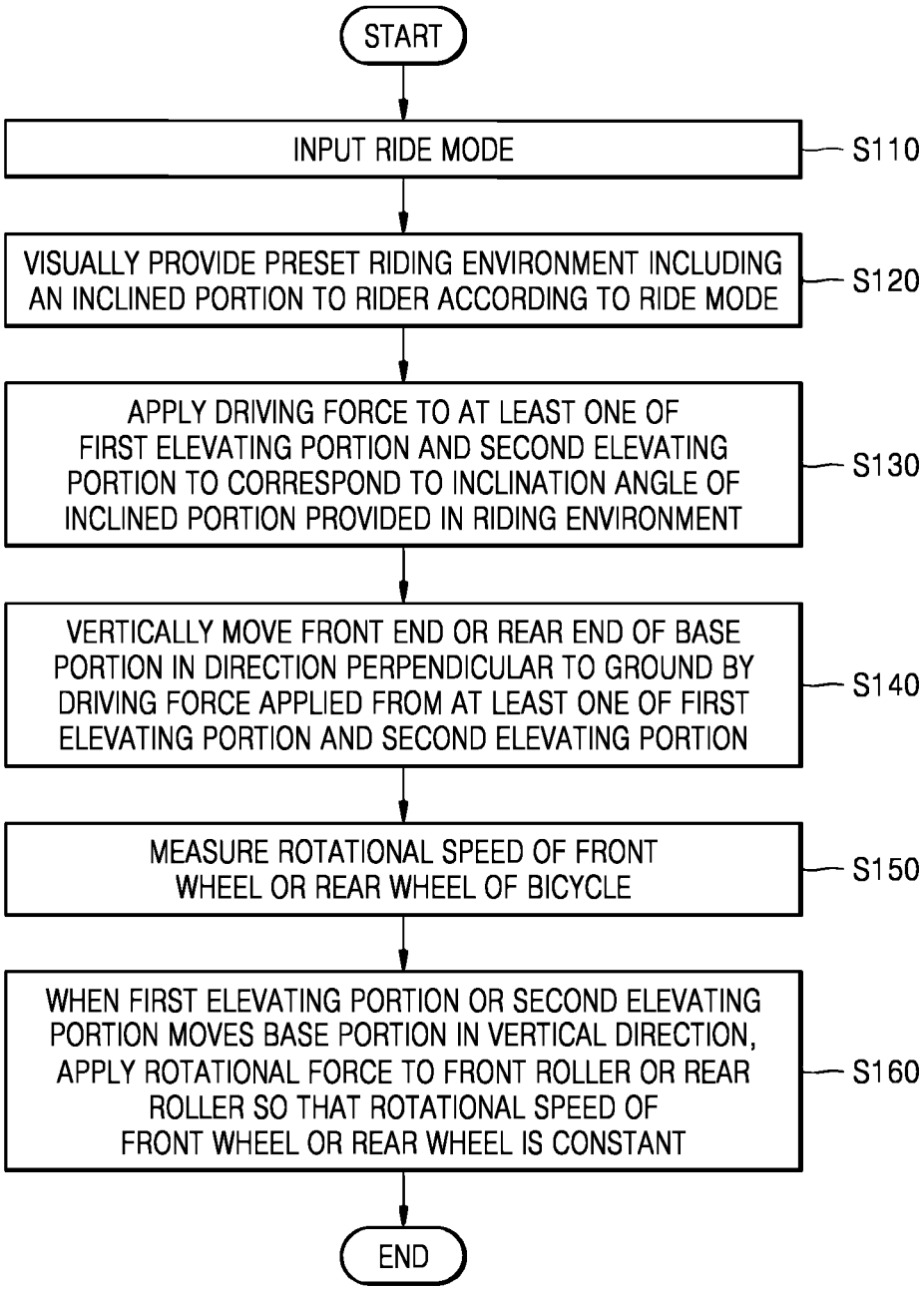
FIG. 10 is a flowchart of a method of operating a bicycle simulator, according to an embodiment of the present disclosure.

FIG. 10 is a flowchart of a method of operating a bicycle simulator, according to an embodiment of the present disclosure.

Referring to FIG. 10, the rider R may input a ride mode to be ridden, by using the input unit 76, in operation S110. As an example, when the input unit 76 is a terminal that transmits a query and receives a response by using an artificial intelligence-based chatbot, a ride mode according to any one of a plurality of scenarios that are pre-mapped according to a ride mode including the information on a mountain road to be ridden queried by the rider R may be selected. At this time, the input of the rider R using the input unit 76 may include input to manipulate buttons, key pads, a mouse, a trackball, a jog switch, a knob, etc., input to touch a touch pad or touch screen, voice input, motion input, biometric information input (e.g., iris recognition, fingerprint recognition, etc.), but is not limited thereto. For example, when the input unit 76 inputs an input signal by the voice input method, when the rider R is a visually-impaired person, or when two hands of the rider R are fixed to the handle bars and cannot be used, an input signal related to a ride mode, etc. may be transmitted to the controller 70.

The display device 75 may visually provide a preset riding environment including an inclined portion to the rider R according to the ride mode selected by the rider R, in operation S120. As an example, an actual mountain bike riding route input by the rider R may be displayed on the display device 75. Accordingly, the rider R may visually experience various ride conditions including the inclination angle δ.

The controller 70 may apply the driving force to at least one of the first elevating portion 61 and the second elevating portion by using the first driver 63, in operation S130. As an example, the controller 70, after recognizing a ride condition implemented in the display device 75, may manipulate the first driver 63 to respond to the ride condition. For example, the controller 70 may operate the first driver 63 to raise or lower the pistons 612 and 622 provided in the first elevating portion 61 or the second elevating portion 62 in the z-axis direction.

The front end or rear end of the base portion 20 may move vertically in a direction perpendicular to the ground by a driving force applied from at least one of the first elevating portion 61 and the second elevating portion 62, in operation S140. As an example, when the pistons 612 and 622 respectively provided in the first elevating portion 61 or the second elevating portion 62 rise or fall in the z-axis direction, the base portion 20 supported by the pistons 612 and 622 may be accordingly inclined at an inclination angle δ. Thus, the bicycle 10 supported on the base portion 20 may also be arranged to have the inclination angle δ with respect to the ground, and the rider R may more safely enjoy a dynamic experience in an indoor space as if he or she is riding on a mountain road having an inclination angle.

The first speed measuring portion 71-1 and the second speed measuring portion 71-2 may measure the rotational speed of the front wheel 14 or the rear wheel 12 of the bicycle 10, in operation S150. As an example, the first speed measuring portion 71-1 and the second speed measuring portion 71-2 may measure the rotation speed of the front wheel 14 and the rear wheel 12 and transmit the measurement to the controller 70.

When the first elevating portion 61 or the second elevating portion 62 moves the base portion 20 in the vertical direction to form the inclination angle δ, the controller 70 may apply a rotational force to the front roller 40 or the rear roller 50 so that the rotation speed of the front wheel 14 or the rear wheel 12 is constant, in operation S160. As an example, when the bicycle 10 supported on the base portion 20 is arranged to have an inclination angle δ with respect to the ground by the first elevating portion 61 or the second elevating portion 62, the rotation speeds of the front wheel 14 and the rear wheel 12 may not match each other. At this time, the controller 70 may control the $(2\text{-}1)^{st}$ driver 80 and the $(2\text{-}2)^{nd}$ driver 90 to apply a rotational force to at least one of the front roller 40 and the rear roller 50. Accordingly, the rotation speeds of the front wheel 14 and the rear wheel 12 may be matched, and the rider R may experience the same ride condition as the actual ride condition.

In the above, although specific embodiments of the present disclosure have been described and illustrated, it will be obvious to those of skill in the art that the present disclosure is not limited to the described embodiments, and that various modifications and variations may be made without departing from the spirit and scope of the present disclosure. Accordingly, such modifications or variations should not be individually understood from the technical spirit or viewpoint of the present disclosure, and the modified embodiments should be said to belong to the claims of the present disclosure.

What is claimed is:

1. A bicycle simulator comprising:

a base portion;

a front roller configured to support a front wheel of a bicycle that is mounted to the bicycle simulator, and rotate together with a rotation of the front wheel, the front roller having a first end and a second end, wherein the first end and the second end of the front roller are connected to the base portion;

a rear roller configured to support a rear wheel of the bicycle, and rotate together with a rotation of the rear wheel, the rear roller having a first end and a second end, wherein the first end and the second end of the rear roller are connected to the base portion;

a first speed sensor arranged on the front roller and configured to detect a rotational speed of the front roller;

a second speed sensor arranged on the rear roller and configured to detect a rotational speed of the rear roller;

a first driver connected to one of the first end or the second end of the front roller via the base portion and configured to apply a rotational force to the front roller based on the rotational speed of the front roller detected by the first speed sensor to have the rotational speed of the front roller correspond to a rotation speed of the front wheel of the bicycle; and a second driver connected to one of the first end or the second end of the rear roller via the base portion and configured to apply a rotational force to the rear roller based on the rotational speed of the rear roller detected by the second speed sensor to have the rotational speed of the rear roller correspond to a rotation speed of the rear wheel of the bicycle, wherein the first driver and the second driver are controlled to make the rotational speed of the front roller equal to the rotational speed of the rear roller, thereby providing a stable ride experience to a rider.

2. The bicycle simulator of claim 1, further comprising:

a frame support portion connected to the base portion between the front roller and the rear roller and configured to support a frame of the bicycle, wherein the frame support portion includes a support bar and a fixed support portion receiving one end of the support bar and guiding the support bar to move in a vertical direction relative to a ground, the support bar being a linear rod-shaped support member;

wherein the front roller, the rear roller, and the frame support portion are movably coupled with respect to the base portion in a length direction of the base portion; and wherein the front roller, the rear roller, and the frame support portion are movably coupled with respect to the base portion in a thickness direction of the base portion.

3. The bicycle simulator of claim 2, further comprising:

an elastic member arranged below the support bar and configured to mitigate an impact applied to the rider.

4. The bicycle simulator of claim 1, further comprising:

an input unit for inputting a ride mode and a riding environment.

5. The bicycle simulator of claim 4, wherein the input unit is a terminal device that transmits a query and receives a response by using an artificial intelligence-based chatbot.

6. The bicycle simulator of claim 1, wherein the first speed sensor comprises an encoder.

7. The bicycle simulator of claim 1, further comprising:

an air blower configured to provide variable wind to the rider according to a riding speed calculated based on at least one of the rotation speed of the front wheel and the rotation speed of the rear wheel.

8. The bicycle simulator of claim 1, further comprising:

a frame support portion connected to the base portion between the front roller and the rear roller and supporting a frame of the bicycle;

wherein the front roller supports the front wheel at a single point, the single point being a lowermost end of the front wheel;

wherein the rear roller supports the rear wheel at a single point, the single point being a lowermost end of the rear wheel; and wherein the front roller, the rear roller, and the frame support portion are movably coupled with respect to the base portion in a length direction of the base portion.

* * * * *